US006112529A

United States Patent [19]

Curbow et al.

[11] Patent Number: 6,112,529

[45] Date of Patent: Sep. 5, 2000

[54] CARBON DIOXIDE VAPORIZER

[76] Inventors: Jeffery L. Curbow, 880 Hall Ave., Fayetteville, Ark. 72701; Marion T. Cook, 2607 N. Second St., Rogers, Ark. 72756

[21] Appl. No.: 09/224,569

[22] Filed: Dec. 30, 1998

[51] Int. Cl.[7] ..... F17C 9/02

[52] U.S. Cl. ..... 62/50.2; 62/904

[58] Field of Search ..... 62/50.2, 904

[56] References Cited

U.S. PATENT DOCUMENTS

| | | | |
|---|---|---|---|
| 2,089,428 | 8/1937 | Ross et al. | 62/50.2 |
| 2,343,727 | 3/1944 | Zenner | 62/1 |
| 2,576,984 | 12/1951 | Wildhack | 62/50.2 |
| 2,729,948 | 1/1956 | Northgraves | 62/1 |
| 2,833,121 | 5/1958 | Dorf | 62/50.2 |
| 3,475,916 | 11/1969 | Smith | 62/52 |
| 3,712,073 | 1/1973 | Arenson | 62/52 |
| 3,754,407 | 8/1973 | Tyree, Jr. | 62/55 |
| 4,174,619 | 11/1979 | Tocha | 62/52 |
| 4,242,986 | 1/1981 | Bo | 122/33 |
| 4,590,770 | 5/1986 | Howard | 62/52 |
| 4,718,481 | 1/1988 | Delatte | 62/50.2 |
| 5,243,821 | 9/1993 | Schuck et al. | 62/50.6 |
| 5,372,011 | 12/1994 | O'Neal | 62/93 |
| 5,390,500 | 2/1995 | White et al. | 62/50.2 |

*Primary Examiner*—Ronald Capossela
*Attorney, Agent, or Firm*—Head, Johnson & Kachigan

[57] ABSTRACT

The invention comprises a system for supplying carbon dioxide liquids while maintaining a desirable pressure in a liquid carbon dioxide storage vessel. In an exemplary embodiment, an improved vaporizer is deployed in a downstream line from the storage vessel. The vaporizer converts a portion of the withdrawn liquid carbon dioxide into replacement carbon dioxide vapor using heat from steam or electricity supplied by the facility. This replacement carbon dioxide vapor is returned to the storage vessel to maintain the desired internal tank pressure as liquified carbon dioxide is withdrawn. The vaporizer includes an elongated cylindrical steel shell with spaced apart ends. Each end has a steel end cap that is welded to the body. Either end cap may be removed to service the vaporizer. The vaporizer body is penetrated by three ports, a steam inlet, a liquid carbon dioxide inlet and a carbon dioxide vapor outlet. The steam inlet accepts steam from the facility while the inlet accepts liquid carbon dioxide and the outlet emits carbon dioxide vapors. Other types of heating mediums such as air or hot water, may be used as well. The vaporizer body houses a tubing unit for vaporizing the liquid carbon dioxide. The tubing unit has an inlet, outlet and vaporization section. The vaporization section tubing is preferably formed from copper while the inlet and outlet pipes are preferably steel. The tubing unit includes several individual coils wound in a series of loops extending between the inlet and outlet pipes respectfully. When servicing the vaporizer, the technician may remove an end cap by cutting it off with a welding torch or another suitable method. The tubing unit may then be freed by uncoupling the inlet unions adjacent the inlet ports. The entire tubing unit may then be removed from the body.

5 Claims, 4 Drawing Sheets

CARBON DIOXIDE VAPORIZER

BACKGROUND OF THE INVENTION

1. Field of the Invention

The present invention relates generally to a system for maintaining pressure in a pressurized storage vessel as liquified gases are withdrawn therefrom. More particularly, the present invention relates to a vaporizer for reliably producing sufficient carbon dioxide vapors from liquified carbon dioxide to replace exiting liquids in the pressurized storage vessel.

2. Known Art

As will be appreciated by those skilled in the art, carbon dioxide is typically liquified for convenient transport between production facilities and users. The delivered liquid carbon dioxide is normally stored at an elevated pressure in a suitable pressure vessel to maintain its liquidity.

The stored liquid carbon dioxide is used in a wide variety of commercial and industrial processes. For example, "blast freezing" with liquid carbon dioxide is employed by many food processing facilities to quickly freeze food products and the like. Often the carbon dioxide liquid must be withdrawn in large quantities from the storage vessel for use in the process (especially blast freezing and the like). However, the withdrawal of liquids from the vessel causes a pressure drop in the vessel. The resultant pressure drop causes the inner temperature of the storage vessel to rise, which results in further vaporization of the valuable liquified carbon dioxide. This vaporization occurs every time liquid is withdrawn and depletes the quantity of liquid available for the facility. As such, this vaporization process is undesirable.

One method of preventing undesirable carbon dioxide vaporization is to maintain a constant pressure in the storage vessel. This is accomplished by simultaneously adding replacement vapor to the vessel to replace the exiting liquid. Thus, as liquids are withdrawn, carbon dioxide vapors are added so that the interior pressure remains constant in the vessel. A popular way of obtaining carbon dioxide vapor to replace the exiting liquid is to vaporize a small portion of the exiting liquid. Conventional vaporizers have heretofore been employed to accomplish this task. Examples of such devices are shown in several patents of general relevance.

U.S. Pat. No. 2,343,727 to Zenner discloses a vaporizing device for vaporizing volatile liquids such as oxygen, nitrogen and the like. The vaporizer uses a unitary manifold disposed inside a shell. U.S. Pat. No. 4,590,770 to Howard discloses a cryogenic liquid heat exchanger for vaporizing cryogenic liquids. This device employs a single tube for vaporizing the liquid using indirect heating.

U.S. Pat. No. 3,712,073 shows another interesting vaporizer as well. This vaporizer is associated with storage tanks and shows the associated pumping and piping with such a conventional arrangement. U.S. Pat. No. 5,243,821 shows another process of general relevance. The process produces gases over a wide range of flow rates.

These devices may work well for their intended uses with small installations. However, no known device works well for large installations, particularly those large installations processing food. For example, large poultry processing facilities use liquified carbon dioxide to maintain and/or quickly freeze processed poultry. Such plants typically require 30–60 tons of liquid carbon dioxide daily. Furthermore, given the strict FDA standards for the time periods and temperatures during which poultry must be processed and packaged, it is critical that the liquified carbon dioxide supply system function adequately at all times. For example, current FDA guidelines require that the chicken carcasses be maintained at 34° fahrenheit and that they be packaged promptly after blast freezing.

Another problem associated with the known art is its unreliability. The known vaporizers often suffer from "freeze-ups" where they cease working properly. During such failures, the entire processing facility must often cease all work until the liquid carbon dioxide supply can be reestablished. As may well be imagined, such work stoppages cripple production and should be avoided.

However, the known art fails to provide a suitable vaporizer that efficiently vaporizes the liquid carbon dioxide in sufficient quantities to meet the daily demand of large commercial installations. An improved vaporizer that facilitated maintenance and repair would also be desirable. An ideal vaporizer would resist freeze-ups to ensure a constant supply of liquid carbon dioxide. It is also desirable to provide an improved vaporizer that reliably produces significant quantities of carbon dioxide vapor without requiring significantly higher steam and/or electrical energy and is of minimal size.

Thus, a need exists for an improved vaporizer to overcome the perceived deficiencies.

SUMMARY OF THE INVENTION

The present invention overcomes the perceived problems associated with the known art. The invention comprises a system for supplying carbon dioxide liquids while maintaining a desirable pressure in a liquid carbon dioxide storage vessel. In an exemplary embodiment, an improved vaporizer is deployed in a downstream line from the storage vessel. The vaporizer converts a portion of the withdrawn liquid carbon dioxide into replacement carbon dioxide vapor using heat from steam or electricity supplied by the facility. This replacement carbon dioxide vapor is returned to the storage vessel to maintain the desired internal tank pressure as liquified carbon dioxide is withdrawn.

The vaporizer includes an elongated cylindrical steel shell with spaced apart ends. Preferably, each end has a steel end cap that is welded to the body. Either end cap may be removed to service the vaporizer. The vaporizer body is penetrated by three ports, a steam inlet, a liquid carbon dioxide inlet and a carbon dioxide vapor outlet. The steam inlet accepts steam from the facility while the inlet accepts liquid carbon dioxide and the outlet emits carbon dioxide vapors. Of course, other types of heating mediums such as air or hot water, may be used as well.

The vaporizer body houses a tubing unit for vaporizing the liquid carbon dioxide. The tubing unit has an inlet, outlet and vaporization section. The vaporization section tubing is preferably formed from copper while the inlet and outlet pipes are preferably steel. The tubing unit includes several individual coils wound in a series of loops extending between the inlet and outlet pipes respectfully.

When servicing the vaporizer, the technician may remove an end cap by cutting it off with a welding torch or another suitable method. The tubing unit may then be freed by uncoupling the inlet unions adjacent the transfer ports. The entire tubing unit may then be removed from the body entirely. In this manner, the vaporizer may be quickly serviced by a technician with minimal down time. Since a replacement tubing unit may be also installed at this time, the vaporizer may typically be returned to operation within a matter of minutes.

Thus, a principal object of the present invention is to provide an improved system for supplying liquified carbon dioxide to an associated facility by vaporizing a portion of the existing liquid carbon dioxide and subsequently returning the vapor to the storage vessel to replace withdrawn liquids.

Another basic object of the present invention is to provide an efficient vaporizer that quickly and efficiently vaporizes liquid carbon dioxide.

Another basic object of the present invention is to provide an improved method for vaporizing a portion of withdrawn liquid carbon dioxide for maintaining the requisite pressure in an associated storage vessel dispensing liquified carbon dioxide.

Another object of the present invention is to provide an improved vaporizer that may be easily serviced.

Another object of the present invention is to provide a vaporizer that resists freezing and/or clogging and/or icing.

A basic object of the present invention is to provide a system for supplying liquid carbon dioxide to a food processing facility reliably.

A related object of the present invention is to provide a vaporizer that reliably works with a supply system for liquid carbon dioxide.

Another object of the present invention is to provide a liquid carbon dioxide supply and vaporizer therefore that permit uninterrupted food processing in an associated facility.

Yet another object of the present invention is to provide a system that supplies refrigerating liquid to a food processing facility without lengthy failure.

DETAILED DESCRIPTION OF THE PREFERRED EMBODIMENTS

Figure 1:
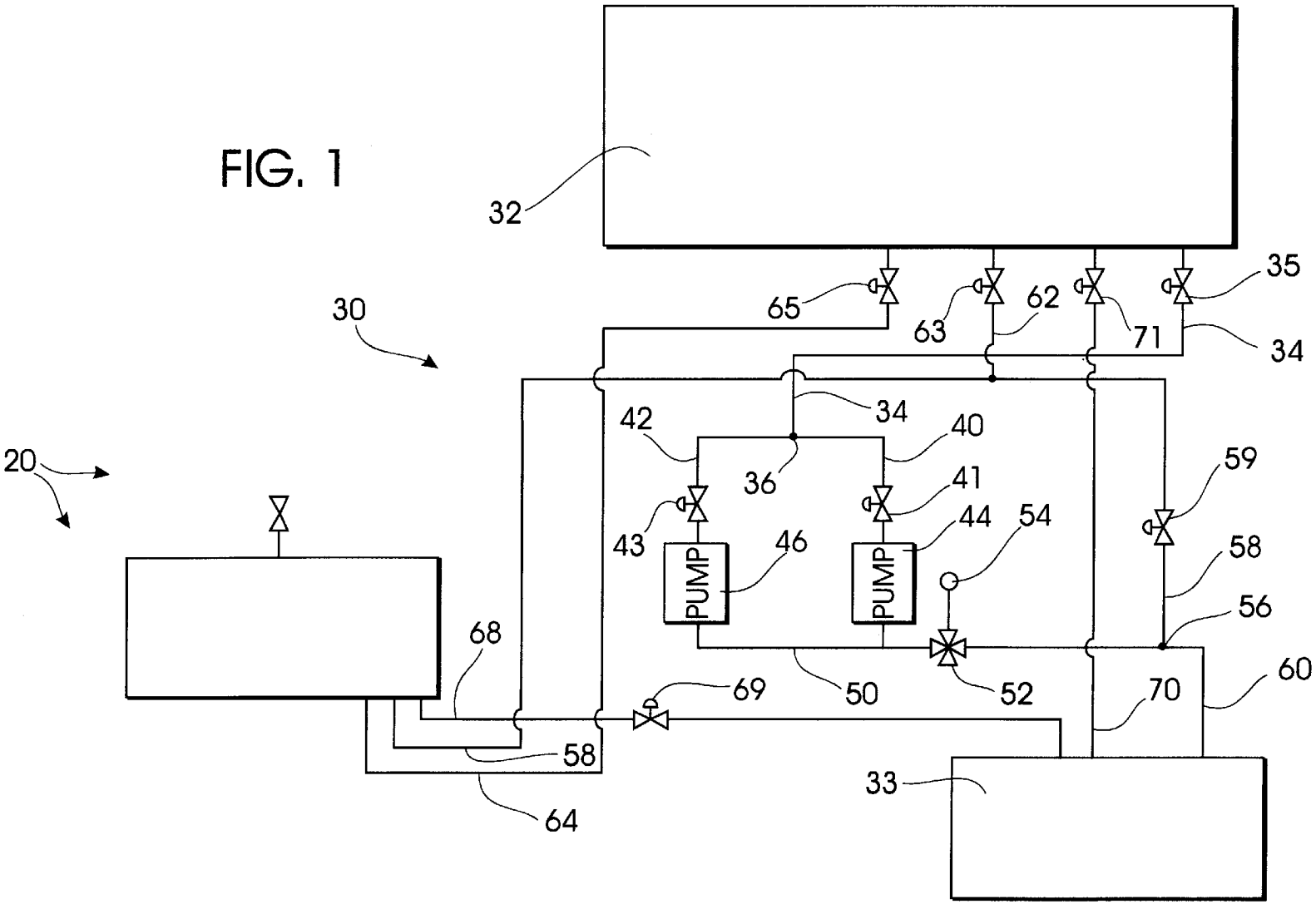
FIG. 1 a schematic diagram of an exemplary installation in which the vaporizer has been deployed.
Figure 2:
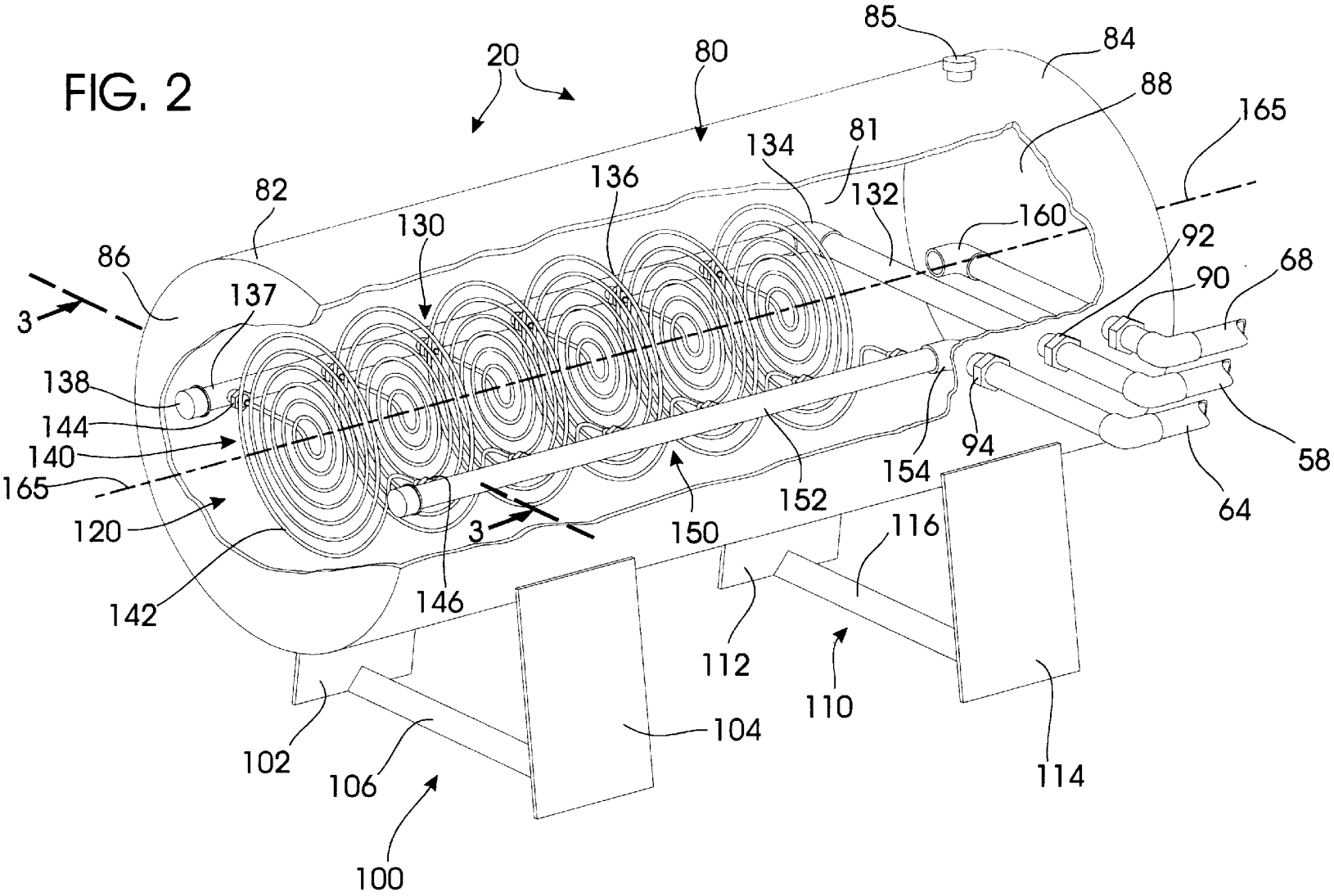
FIG. 2 is a partially fragmented, perspective view of an exemplary embodiment of the vaporizer.
Figure 3:
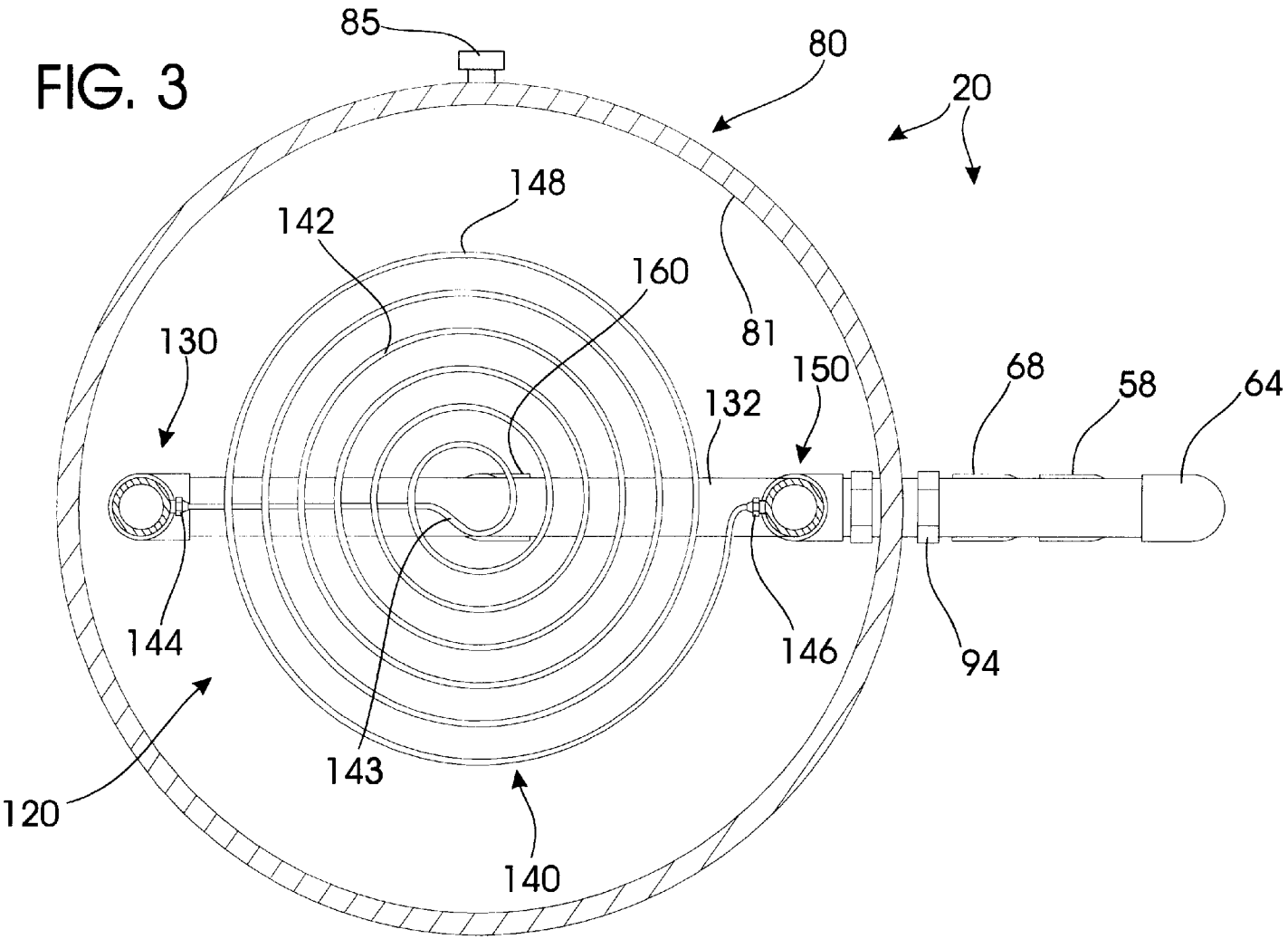
FIG. 3 is a cross-sectional view taken along line 3—3 from FIG. 2; and, FIG. 4 is a partially exploded perspective view of the invention.
Figure 4:
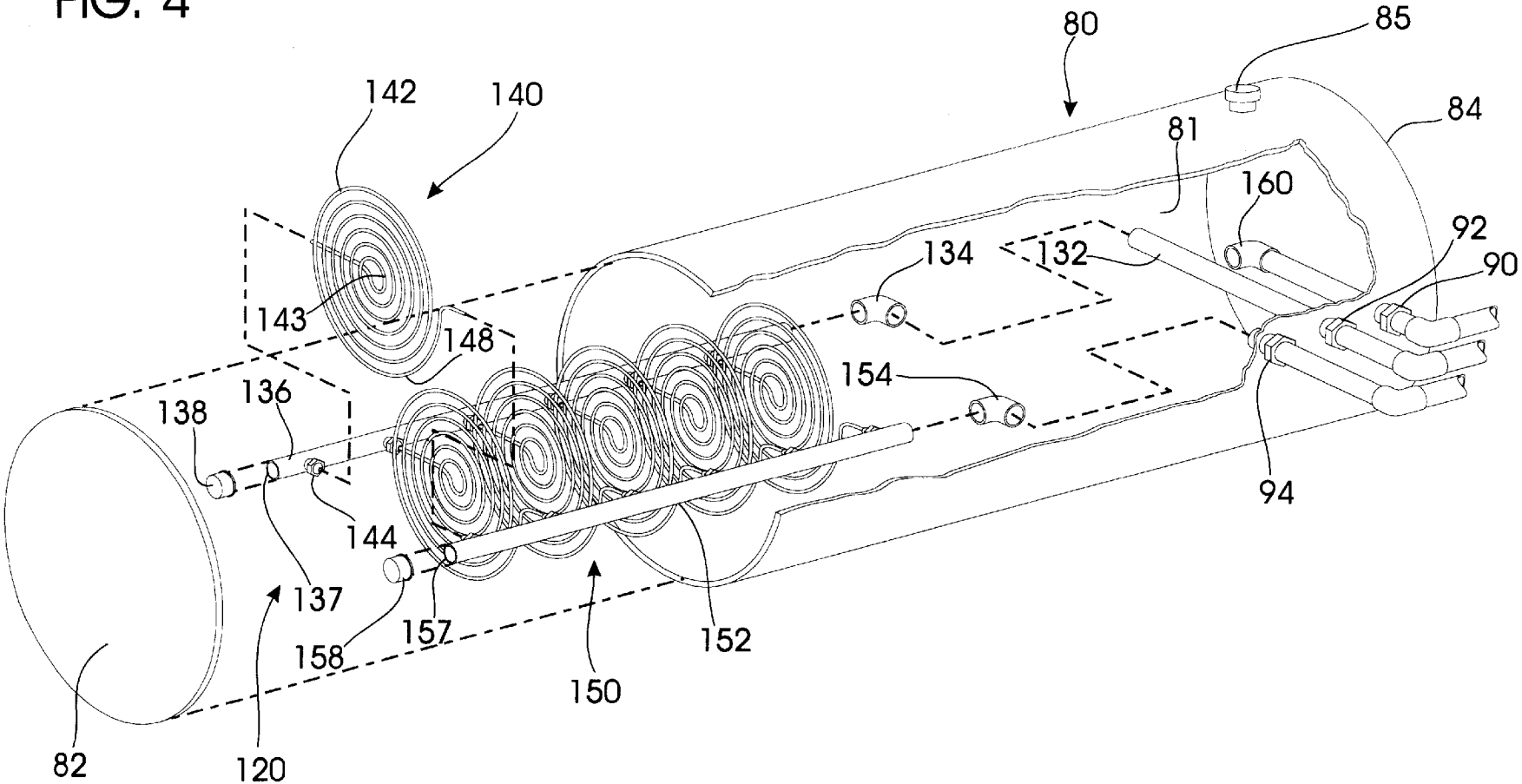

The vaporizer of the present invention is broadly designated by reference numeral 20 in FIGS. 1–4. The vaporizer 20 may be utilized in a wide variety of commercial and/or industrial processes as desirable. In one exemplary deployment, the vaporizer 20 is associated with a commercial process 30 wherein the vaporizer is used to maintain a desirable pressure in an associated storage vessel 32. The storage vessel 32 supplies a liquified gas such as carbon dioxide to the associated commercial production facility 33. A portion of the liquid exiting the storage vessel 32 is piped to the vaporizer 20 where it is converted into a vapor that is subsequently returned to the storage vessel 32. In this fashion, the interior pressure of vessel 32 may be maintained at a desirable level.

The vaporizer 20 receives liquid carbon dioxide from the storage vessel 32 via the liquid out line 34 with control valve 35. Line 34 tees at junction 36 into pump supply lines 40 and 42 with control valves 41 and 43. Pumps 44 and 46 increase the supply fluid pressure to a level adequate to push the liquid carbon dioxide throughout the facility. The fluid line 50 goes through check valve 52 with gauge 54 that monitors the outgoing pressure. At juncture 56, the outlet line 50 branches into a vaporizer supply line 58 and a plant supply line 60. The vaporizer supply line 58 has control valve 59 so that the vaporizer supply of liquid may be controlled by a branch line 62 with control valve 63. The branch line 62 returns a select amount of liquid carbon dioxide directly to the vessel 32.

Supply line 58 enters the vaporizer via the liquid inlet port, as will be described more thoroughly hereinafter. The vapor return line 64 exits the vaporizer via the vapor outlet port, as will also be described in more detail hereinafter. Vapor return line 64 is controlled by valve 65. A separate steam line 68 supplies steam to the vaporizer via control valve 69. Preferably, the steam is supplied by the associated facility as part of its processing although this is not necessarily so. The heating medium need not be steam but may be heated air, hot water or the like. A return fluid line 70 returns excess carbon dioxide liquid from the plant facility to the storage vessel 32 via control valve 71.

The vaporizer 20 vaporizes a portion of the liquified carbon dioxide exiting the storage vessel 32. This is necessary because the exiting liquid reduces the pressure inside the vessel 32 which results in vaporization of a portion of the liquid to occupy the additional volume inside the tank. By increasing the vapor inside the tank with a high pressure vapor, the loss of liquified carbon dioxide may be minimized by preserving the pressure inside the tank. In one embodiment, the vaporizer 20 saves approximately 10–20% usage for a 300 ton daily user.

The vaporizer 20 may assume a variety of shapes, sizes and dimensions. In an exemplary embodiment, the vaporizer 20 comprises an elongated hollow cylindrical shell or body 80. The shell 80 has spaced apart ends 82 and 84. Preferably, each end 82, 84 is covered by an arcuate end cap 84 and 86 respectively. Preferably, each end cap 86 and 88 is welded to each respective end 82, 84. In an exemplary embodiment, the body 80 is formed from higro test steel to withstand pressures of 350 PSI. Bodies with four, three, or two foot lengths and two foot diameters have been found to work well Of course, other dimensions could be used as necessary to handle higher or lower vaporization loads. Body 80 also has an emergency pop-off 85 for releasing pressure during emergencies.

Body 80 is penetrated by three transfer ports 90, 92 and 94 proximate end 84. Preferably, ports 90, 92 and 94 are formed by two inch steel unions. The ports admit liquid carbon dioxide and steam into vaporizer 20 and emit vaporized carbon dioxide from the vaporizer 20. Steam enters the vaporizer 20 via line 68 coupled to inlet port 90. Liquid carbon dioxide enters the vaporizer 20 via line 58 coupled to inlet port 92. Vaporized carbon dioxide exits the body 80 via outlet port 94 coupled to line 64.

The body 80 rests upon a pair of spaced apart support legs 100 and 110 proximate each end 86 and 88. Support leg 100 comprises spaced apart struts 102 and 104 with reinforcing angle bar 106 spanning therebetween. Support leg 110 comprises spaced apart struts 112 and 114 with a reinforcing angle bar 116 spanning therebetween.

Body 20 houses an internal tubing unit 120. Tubing 120 conducts the liquids into the body 80 where it is vaporized and subsequently conducts the vapors out from body 80. Tubing unit 120 comprises an inlet section 130, a vaporization section 140 and an outlet section 150.

Inlet section 130 includes a first pipe 132 conducting the entering liquid carbon dioxide into and laterally across the interior 81 of the body 80. Pipe 132 turns at a 90° elbow 134 and runs into an elongated distribution pipe. 136. Distribution pipe 136 extends longitudinally along the body interior 81 adjacent the body exterior. The terminal end 137 of pipe 136 is capped by a weld cap 138. The inlet section 130 components are preferably formed from two inch steel pipe to withstand the rigors and pressures involved during the vaporization process. In an exemplary embodiment, pipe 132 is approximately two feet long while pipe 136 is approximately three and a half feet long. Ideally, pipe 132 runs in front of steam outlet 160 so that the entering liquid is initially heated by the entering steam.

The central vaporization section 140 includes a plurality of identical, looped tubing units 142. Each pipe 142 intersects the inlet pipe at a juncture 144. Juncture 144 permits cold liquid carbon dioxide to enter the looped tubing 142 and proceed to the center of the vaporizer. As the fluid travels through loop 142 it progresses from the center of the vaporizer toward the periphery. Fluids exit each tubing unit 142 at a corresponding tubing juncture 146 where they enter the outlet pipe section 150. While the fluids are in the looped tube 142, they change from the liquid phase into a vapor phase. Ideally, each tube 142 is comprised of 60 feet of half inch copper tubing. The tubing is preferably wound into a radial loop 148 with a mid-point 143 coplanar to the steam outlet 160. Ideally, the mid-points 143 of all of the loops 148 and the steam outlet 160 align along line 165. As the fluids progress to the outermost loop 148, they are evenly heated to force the phase change of the carbon dioxide. Thus, each loop 148 radially diverges from the inlet juncture 144 to the outlet juncture 146. By the time the vapors reach juncture 146 to enter the outlet section 150, the phase change has been completed.

Outlet section 150 comprises an elongated pipe 152 that is preferably parallel to pipe 136. A 90° elbow juncture 154 redirects 152 into union 94. The terminal end 157 of pipe 152 is capped by weld cap 158.

The vaporizer 20 may be easily serviced by technicians without extensive training or equipment. The technician may service the vaporizer 20 by removing the end cap 84 adjacent the ports 90, 92, and 94. The end cap 84 is typically removed by cutting it off with a torch or the like. After the end cap 84 is removed, the technician unscrews the unions. This releases the tubing unit 120 at pipe 132 and 155. Next, the entire tubing unit 120 is completely removed from the interior 81. A replacement tubing unit can be inserted or the tubing unit may be repaired and then reinserted. Finally, the end cap 82 is re-welded to the body 80 in a conventional manner.

Whereas, the present invention has been described in relation to the drawings attached hereto, it should be understood that other and further modifications, apart from those shown or suggested herein, may be made within the spirit and scope of this invention.

What is claimed is:

1. A vaporizer for heating entering liquids to transform said liquids into a vapor, said vaporizer comprising:

an elongated body housing an internal tubing unit, said body having at least three ports defined adjacent one of said ends;

an interior heat dispensing pipe associated with one of said ports;

an inlet pipe associated with another of said ports, said inlet pipe traversing the body of said vaporizer and fluid flow communication with a distribution pipe parallel to the longitudinal axis of said body;

an outlet pipe associated with the last of said ports, said outlet pipe parallel to and spaced apart from said distribution pipe; and, a plurality of regularly spaced apart vaporization tubes extending between said inlet section and said outlet section, each of said vaporization tubes comprising a pipe wound to radially diverge from said inlet to said outlet section so that entering liquids are vaporized prior to reaching said outlet section; and, means for heating said vaporization section to completely vaporize said entering fluids to produce said exiting vapor, said means comprising an outlet and wherein said inlet pipe is proximate said outlet and wherein each of said vaporization tubes further comprises a mid-point and each of said mid-points are parallel to the longitudinal axis of said body and wherein said heat dispensing pipe outlet is coplanar to said mid-points.

2. The vaporizer as recited in claim 1 wherein said means for heating comprises steam supplied from an associated facility.

3. The vaporizer as recited in claim 2 wherein said body is supported by spaced apart support stands to stabilize said vaporizer adjacent each of said ends.

4. A vaporizer for heating entering liquids to transform said liquids to transform said liquids into an exiting vapor, said vaporizer comprising:

a elongated body with spaced apart ends, said body housing an internal tubing unit, and having at least three ports defined adjacent one of said ends;

an inlet pipe coupled to another of said ports, said inlet pipe traversing the body of said vaporizer and in fluid flow communication with a distribution pipe parallel to the longitudinal axis of said body;

an outlet pipe coupled to the last of said ports, said outlet pipe parallel and spaced apart from said distribution pipe;

a plurality of regularly spaced apart vaporization tubes extending between said inlet section and said outlet section, each of said vaporization tubes comprising a pipe wound to radially diverge from said inlet to said outlet section so that entering liquids are vaporized prior to reaching said outlet section; and means for dispensing a heating medium inside said body to heat said vaporization section to completely vaporize said entering fluids to produce said exiting vapor, said means comprising an outlet and wherein said inlet pipe is proximate said outlet and wherein each of said vaporization tubes further comprises a mid-point and each of said mid-points are parallel to the longitudinal axis of said body and wherein said heat dispensing pipe outlet is coplanar to said mid-points, and, spaced apart support stands to stabilize said vaporizer adjacent each of said ends.

5. The vaporizer as recited in claim 4 wherein said body further comprises an emergency pop-off adapted to quickly release pressure from said body in emergency situations.

* * * * *